US011769952B2

(12) United States Patent
Huang et al.

(10) Patent No.: US 11,769,952 B2
(45) Date of Patent: Sep. 26, 2023

(54) ANTENNA ELEMENT AND ELECTRONIC DEVICE

(71) Applicant: VIVO MOBILE COMMUNICATION CO., LTD., Guangdong (CN)

(72) Inventors: Huan-Chu Huang, Guangdong (CN); Rongjie Ma, Guangdong (CN); Xianjing Jian, Guangdong (CN)

(73) Assignee: VIVO MOBILE COMMUNICATION CO., LTD., Guangdong (CN)

( * ) Notice: Subject to any disclaimer, the term of this patent is extended or adjusted under 35 U.S.C. 154(b) by 83 days.

(21) Appl. No.: 17/531,627

(22) Filed: Nov. 19, 2021

(65) Prior Publication Data

US 2022/0085512 A1 Mar. 17, 2022

Related U.S. Application Data

(63) Continuation of application No. PCT/CN2020/090507, filed on May 15, 2020.

(30) Foreign Application Priority Data

May 22, 2019 (CN) ..... 201910430968.0

(51) Int. Cl.
*H01Q 9/06* (2006.01)
*H01Q 19/18* (2006.01)
(Continued)

(52) U.S. Cl.
CPC ..... *H01Q 9/065* (2013.01); *H01Q 1/523* (2013.01); *H01Q 5/45* (2015.01); *H01Q 5/48* (2015.01); *H01Q 19/18* (2013.01)

(58) Field of Classification Search
CPC ..... H01Q 9/065; H01Q 19/18; H01Q 1/523; H01Q 5/45; H01Q 5/48; H01Q 21/24;
(Continued)

(56) References Cited

U.S. PATENT DOCUMENTS 6,326,922 B1 * 12/2001 Hegendoerfer ..... H01Q 1/38 343/803
8,502,746 B2 * 8/2013 Huang ..... H01Q 9/285 343/819
(Continued)

FOREIGN PATENT DOCUMENTS

CN 102163768 A 8/2011
CN 102804495 A 11/2012
(Continued)

OTHER PUBLICATIONS

International Search Report of International Application No. PCT/CN2020/090507 dated Aug. 24, 2020.
(Continued)

*Primary Examiner* — Vibol Tan
(74) *Attorney, Agent, or Firm* — IP & T GROUP LLP

(57) ABSTRACT

An antenna element includes a substrate, a first vertically polarized dipole antenna, a second vertically polarized dipole antenna, a reflector and a first feeding structure. The substrate has a ground plate. The first vertically polarized dipole antenna includes a first antenna branch and a second antenna branch that are disposed in the substrate at an interval. The second vertically polarized dipole antenna includes a third antenna branch and a fourth antenna branch that are disposed in the substrate at an interval. The reflector includes several reflection pillars that are arranged in the substrate at intervals along a parabola. The first feeding structure electrically connects each of the first antenna branch, the second antenna branch, the third antenna branch, and the fourth antenna branch to the ground plate.

20 Claims, 14 Drawing Sheets

(51) Int. Cl.

| | |
|---|---|
| ***H01Q 5/45*** | (2015.01) |
| ***H01Q 1/52*** | (2006.01) |
| ***H01Q 5/48*** | (2015.01) |

(58) Field of Classification Search
CPC ..... H01Q 19/30; H01Q 1/36; H01Q 1/38; H01Q 1/48; H01Q 1/50; H01Q 19/13
See application file for complete search history.

(56) References Cited

U.S. PATENT DOCUMENTS

| | | | | |
|---|---|---|---|---|
| 9,368,874 | B2 * | 6/2016 | Kim | H01Q 1/286 |
| 10,224,644 | B1 * | 3/2019 | Park | H01Q 21/065 |
| 2011/0063187 | A1 | 3/2011 | Huang | |
| 2012/0146872 | A1 | 6/2012 | Chainon et al. | |
| 2013/0026586 | A1 | 1/2013 | Seok et al. | |
| 2018/0309205 | A1 | 10/2018 | Boryssenko et al. | |
| 2019/0044243 | A1 | 2/2019 | Vollmer et al. | |
| 2019/0067834 | A1 | 2/2019 | Park et al. | |
| 2021/0234275 | A1 | 7/2021 | Zimmerman et al. | |

FOREIGN PATENT DOCUMENTS

| | | | | |
|---|---|---|---|---|
| CN | 103606757 | A | 2/2014 | |
| CN | 104617383 | A | 5/2015 | |
| CN | 106025530 | A | 10/2016 | |
| CN | 106104914 | A | 11/2016 | |
| CN | 107154536 | A | 9/2017 | |
| CN | 108701893 | A | 10/2018 | |
| CN | 110176668 | A | 8/2019 | |
| KR | 1366784 | B1 * | 2/2014 | H01Q 1/28 |
| KR | 10-2018-0003515 | * | 1/2018 | H01Q 11/10 |
| TW | 201110463 | A | 3/2011 | |

OTHER PUBLICATIONS

Written Opinion of The International Searching Authority of International Application No. PCT/CN2020/090507 dated Aug. 24, 2020.

First Office Action of Priority Application No. 201910430968.0 dated Apr. 9, 2020.

Second Office Action of Priority Application No. 201910430968.0 dated Sep. 24, 2020.

Huan-Chu Huang et al., A Simple Planar High-Directivity Yagi-Uda Antenna with a Concave Parabolic Reflector, Antenna Technology (IWAT), 2010 International Workshop on, Mar. 2010, pp. 1-4, XP031676483, IEEE.

Huan-Chu Huang et al., A Compact Dual-Band Printed Yagi-Uda Antenna for GNSS and CMMB Applications, IEEE Transactions on Antennas and Propagation, May 2015, pp. 2342-2348, vol. 63, No. 5, XP011580065, IEEE.

Tzu-Chien Huang et al., End-Fire Quasi-Yagi Antennas with Pattern Diversity on LTCC Technology for 5G Mobile Communications, 2016 IEEE International Symposium on Radio-Frequency Integration Technology (RFIT), Aug. 24, 2016, pp. 1-3, XP032971235, IEEE.

Waleed El-Halwagy et al., Investigation of Wideband Substrate-Integrated Vertically-Polarized Electric Dipole Antenna and Arrays for mm-Wave 5G Mobile Devices, IEEE Access, vol. 6, Dec. 11, 2017, pp. 2145-2157, XP011677479, IEEE.

Kai Da Xu et al., Printed Quasi-Yagi Antennas Using Double Dipoles and Stub-Loaded Technique for Multi-Band and Broadband Applications, IEEE Access, vol. 6, No. 18, Jun. 18, 2018, pp. 31695-31702, XP055925152, IEEE.

Extended European Search Report for European Patent Application No. 20809305.4 issued by the European Patent Office dated Jun. 14, 2022.

* cited by examiner

ANTENNA ELEMENT AND ELECTRONIC DEVICE

CROSS REFERENCE TO RELATED APPLICATIONS

This application is a Bypass Continuation Application of PCT/CN2020/090507 filed on May 15, 2020, which claims priority to Chinese Patent Application No. 201910430968.0 filed on May 22, 2019, which are incorporated herein by reference in their entirety.

TECHNICAL FIELD

The present disclosure relates to the field of antenna technologies, and in particular, to an antenna element and an electronic device.

BACKGROUND

Antennae mainly include patch antennae, Yagi-Uda antennae, dipole antennae, and the like. Requirements for beam transmission performance of an antenna vary depending on scenarios. For example, in some scenarios, the antenna is required to have relatively wide radiation performance; but in some other scenarios, the antenna is required to have high-directivity radiation performance, that is, the antenna is required to have relatively high end-fire performance.

SUMMARY

According to a first aspect, an embodiment of the present disclosure provides an antenna element, including:

a substrate, where the substrate has a ground plate;

a first vertically polarized dipole antenna, where the first vertically polarized dipole antenna includes a first antenna branch and a second antenna branch, and the first antenna branch and the second antenna branch are disposed in the substrate at an interval;

a second vertically polarized dipole antenna, where the second vertically polarized dipole antenna includes a third antenna branch and a fourth antenna branch, and the third antenna branch and the fourth antenna branch are disposed in the substrate at an interval;

a reflector, where the reflector includes several reflection pillars, and the several reflection pillars are arranged in the substrate at intervals along a parabola; and a first feeding structure, where the first feeding structure electrically connects each of the first antenna branch, the second antenna branch, the third antenna branch, and the fourth antenna branch to the ground plate, where the first antenna branch, the second antenna branch, the third antenna branch, and the fourth antenna branch are all located on a focus side of the parabola; and lengths of the first antenna branch and the second antenna branch are both less than lengths of the third antenna branch and the fourth antenna branch.

According to a second aspect, an embodiment of the present disclosure provides an electronic device, including the antenna element provided in the first aspect of the embodiments of the present disclosure.

BRIEF DESCRIPTION OF DRAWINGS

To describe the technical solutions of the embodiments of the present disclosure more clearly, the following briefly describes the accompanying drawings required for describing the embodiments of the present disclosure. Apparently, the accompanying drawings in the following description show merely some embodiments of the present disclosure, and a person of ordinary skill in the art may still derive other drawings from these accompanying drawings.

DESCRIPTION OF EMBODIMENTS

Figure 1:
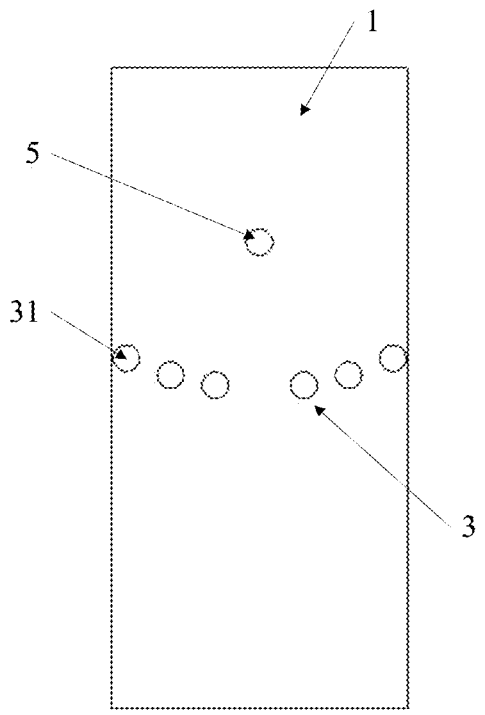
FIG. 1 is a schematic diagram of an external structure of an antenna element according to an embodiment of the present disclosure.

The technical solutions in the embodiments of the present disclosure are described below clearly with reference to the accompanying drawings in the embodiments of the present disclosure. Apparently, the described embodiments are some rather than all of the embodiments of the present disclosure. All other embodiments obtained by a person of ordinary skill in the art based on the embodiments of the present disclosure shall fall within the protection scope of the present disclosure.

As shown in FIG. 1 to FIG. 12 and FIG. 18 to FIG. 20, embodiments of the present disclosure provide an antenna element, including:

a substrate 1, where the substrate 1 has a ground plate 11;

a first vertically polarized dipole antenna 2, where the first vertically polarized dipole antenna 2 includes a first antenna branch 21 and a second antenna branch 22, and the first antenna branch 21 and the second antenna branch 22 are disposed in the substrate 1 at an interval;

a second vertically polarized dipole antenna 5, where the second vertically polarized dipole antenna 5 includes a third antenna branch 51 and a fourth antenna branch 52, and the third antenna branch 51 and the fourth antenna branch 52 are disposed in the substrate 1 at an interval;

a reflector 3, where the reflector 3 includes several reflection pillars 31, and the several reflection pillars 31 are arranged in the substrate 1 at intervals along a parabola; and a first feeding structure 4, where the first feeding structure 4 electrically connects each of the first antenna branch 21, the second antenna branch 22, the third antenna branch 51, and the fourth antenna branch 52 to the ground plate 11, where the first antenna branch 21, the second antenna branch 22, the third antenna branch 51, and the fourth antenna branch 52 are all located on a focus side of the parabola; and lengths of the first antenna branch 21 and the second antenna branch 22 are both less than lengths of the third antenna branch 51 and the fourth antenna branch 52.

The first antenna branch 21 and the second antenna branch 22 of the first vertically polarized dipole antenna 2 are both vertically disposed in the substrate 1. For example, the first antenna branch 21 and the second antenna branch 22 may be disposed in the substrate 1 in a direction perpendicular to the substrate 1 or in another direction slightly deviating from the direction perpendicular to the substrate 1. The central axis of the first antenna branch 21 and the central axis of the second antenna branch 22 may completely coincide with each other, be slightly staggered with each other by a certain angle, or slightly deviate from each other by a certain distance. The lengths of the first antenna branch 21 and the second antenna branch 22 may be equal or approximately equal. The lengths of the first antenna branch 21 and the second antenna branch 22 are approximately a quarter of a wavelength in a medium.

Correspondingly, the third antenna branch 51 and the fourth antenna branch 52 of the second vertically polarized dipole antenna 5 are both vertically disposed in the substrate 1. For example, the third antenna branch 51 and the fourth antenna branch 52 may be disposed in the substrate 1 in a direction perpendicular to the substrate 1 or in another direction slightly deviating from the direction perpendicular to the substrate 1. The central axis of the third antenna branch 51 and the central axis of the fourth antenna branch 52 may completely coincide with each other, be slightly staggered with each other by a certain angle, or slightly deviate from each other by a certain distance. Lengths of the third antenna branch 51 and the fourth antenna branch 52 may be equal or approximately equal. The lengths of the third antenna branch 51 and the fourth antenna branch 52 are approximately a quarter of a wavelength in a medium.

In addition, a connecting line between the end adjacent to the second antenna branch 22 of the first antenna branch 21 and the end adjacent to the fourth antenna branch 52 of the third antenna branch 51 may be parallel to the substrate 1; and a connecting line between the end adjacent to the first antenna branch 21 of the second antenna branch 22 and the end adjacent to the third antenna branch 51 of the fourth antenna branch 52 may also be parallel to the substrate 1.

The reflector 3 is used as a reflector of the first vertically polarized dipole antenna 2 and the second vertically polarized dipole antenna 5. A disposing direction of each reflection pillar 31 in the substrate 1 needs to match that of each antenna branch. In this way, each reflection pillar 31 also needs to be vertically disposed in the substrate 1. For example, each reflection pillar 31 may be disposed in the substrate 1 in a direction perpendicular to the substrate 1 or in another direction slightly deviating from the direction perpendicular to the substrate 1.

In this embodiment of the present disclosure, the first vertically polarized dipole antenna 2, the second vertically polarized dipole antenna 5, and the reflector 3 that is arranged along the parabola are disposed in the substrate 1, and the first vertically polarized dipole antenna 2 and the second vertically polarized dipole antenna 5 are disposed on the focus side of the parabola, so that most beams of the first vertically polarized dipole antenna 2 and the second vertically polarized dipole antenna 5 radiate towards a front end, and radiation towards a back end is reduced, thereby enhancing end-fire performance of the dipole antennae. In addition, the first vertically polarized dipole antenna 2 and the second vertically polarized dipole antenna 5 are disposed, so that the antenna element is endowed with dual-frequency performance, thereby covering a wider bandwidth, and improving communication performance.

Because the lengths of the antenna branches of the first vertically polarized dipole antenna 2 are less than the lengths of the antenna branches of the second vertically polarized dipole antenna 5, the first vertically polarized dipole antenna 2 corresponds to a high frequency, and the second vertically polarized dipole antenna 5 corresponds to a low frequency.

Owing to relatively high end-fire performance, the antenna element in this embodiment of the present disclosure may be set to a millimeter-wave antenna, thereby being adapted to transmission of signals in 5G millimeter-wave bands. In other words, the first vertically polarized dipole antenna 2 and the second vertically polarized dipole antenna 5 may both be millimeter-wave antennae. The lengths of the first antenna branch 21, the second antenna branch 22, the third antenna branch 51, and the fourth antenna branch 52 may be set based on a millimeter-wave wavelength.

Globally mainstream 5G millimeter-wave bands defined by the 3rd Generation Partnership Project (3GPP) include n258 (24.25 GHz to 27.5 GHz) dominated by 26 GHz, n257 (26.5 GHz to 29.5 GHz) dominated by 28 GHz, n261 (27.5 GHz to 28.35 GHz) dominated by 28 GHz, and n260 (37.0 GHz to 40.0 GHz) dominated by 39 GHz.

Assuming that reference frequencies are 28 GHz and 39 GHz, the first vertically polarized dipole antenna 2 corresponds to the frequency of 39 GHz, and the second vertically polarized dipole antenna 5 corresponds to the frequency of 28 GHz.

Optionally, cross section dimensions of the antenna branches of the first vertically polarized dipole antenna 2 are less than cross section dimensions of the antenna branches of the second vertically polarized dipole antenna 5. In this way, the first vertically polarized dipole antenna 2 and the second vertically polarized dipole antenna 5 can better generate resonance, reduce energy reflection, and therefore improve communication performance of the antennae.

Optionally, a plane where the first antenna branch 21, the second antenna branch 22, the third antenna branch 51, and the fourth antenna branch 52 are located penetrate the focus and the vertex of the parabola. In this way, the first vertically polarized dipole antenna 2 and the second vertically polarized dipole antenna 5 are located on a symmetry line of the parabola, which can improve a reflection effect of the reflector 3 on the first vertically polarized dipole antenna 2 and the second vertically polarized dipole antenna 5, thereby increasing gains and front-to-back ratios of radiation patterns of the vertical dipole antennae.

Optionally, the second vertically polarized dipole antenna 5 is located in an area between the first vertically polarized dipole antenna 2 and the reflector 3.

Because the lengths of the antenna branches of the first vertically polarized dipole antenna 2 are less than the lengths of the antenna branches of the second vertically polarized dipole antenna 5, the second vertically polarized dipole antenna 5 is disposed in the area between the first vertically polarized dipole antenna 2 and the reflector 3, so that the antenna branches of the second vertically polarized dipole antenna 5 can serve as a reflector of the first vertically polarized dipole antenna 2, thereby further improving end-fire performance of the entire antenna element.

Optionally, the central axis of the third antenna branch 51 and the central axis of the fourth antenna branch 52 penetrate the focus of the parabola. In this way, a gain of the second vertically polarized dipole antenna 5 can be increased.

It should be noted that, in a case that the ground plate 11 is disposed in a partial area of the substrate 1, for example, a left-side area of the substrate 1, a right-side area of the substrate 1 is a clearance area 12. The entire reflector 3 may be disposed in an area where the ground plate 11 is located. The entire first vertically polarized dipole antenna 2 and the entire second vertically polarized dipole antenna 5 may be both disposed in the clearance area 12. The first feeding structure 4 extends from the clearance area 12 to the area where the ground plate 11 is located.

Optionally, the entire reflector 3 is located in an edge area of the ground plate 11 close to the clearance area 12. In this way, in one aspect, a distance between the reflector 3 and the first vertically polarized dipole antenna 2 can be shortened, thereby improving a reflection effect of the reflector 3 on the first vertically polarized dipole antenna 2, and increasing a front-to-back ratio of a radiation pattern of the first vertically polarized dipole antenna 2. In another aspect, horizontal space that is of the area where the ground plate 11 is located and that is occupied by the entire reflector 3 can be reduced, thereby reserving more space of the area where the ground plate 11 is located for other components.

Optionally, reflection pillars 31 on two sides of the reflector 3 are located at a junction of the ground plate 11 and the clearance area 12. In other words, some of the reflection pillars 31 on the two sides of the reflector 3 are located in the area where the ground plate 11 is located, and the other reflection pillars 31 are located in the clearance area 12.

Figure 3:
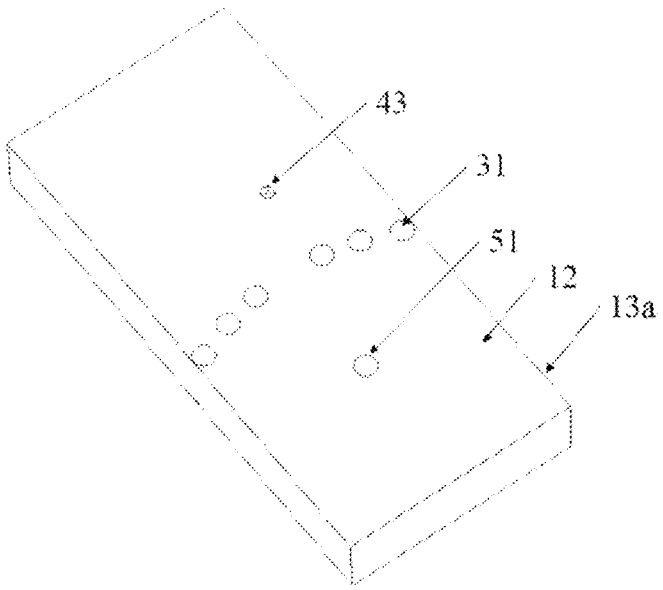
FIG. 3 to FIG. 9 are schematic diagrams of a breakdown structure of an antenna element according to an embodiment of the present disclosure.
Figure 4:
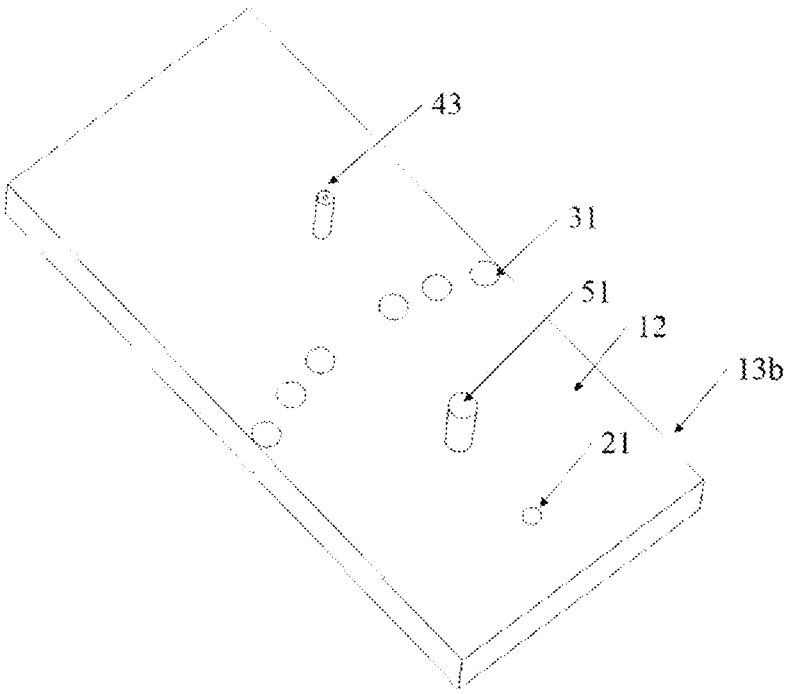
Figure 5:
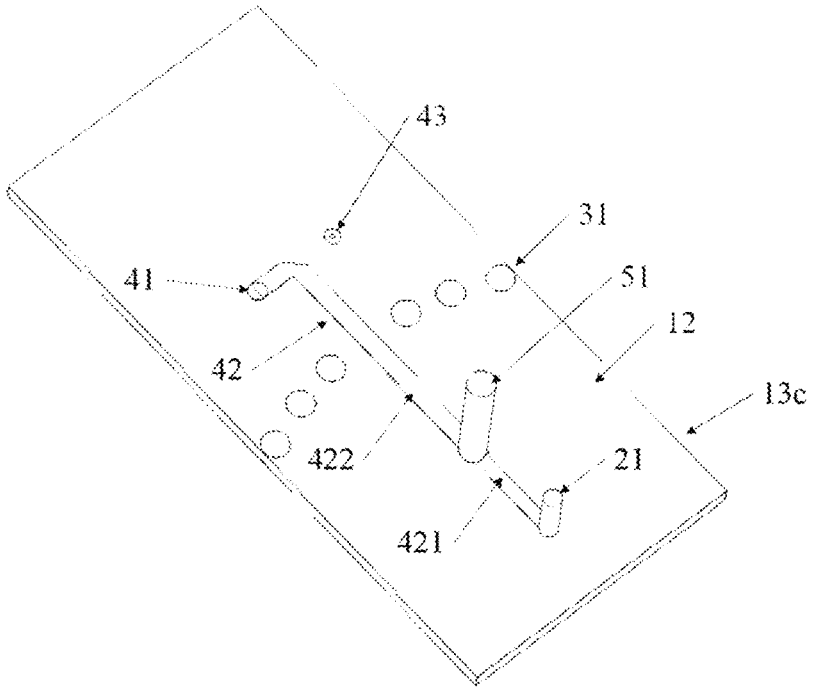
Figure 6:
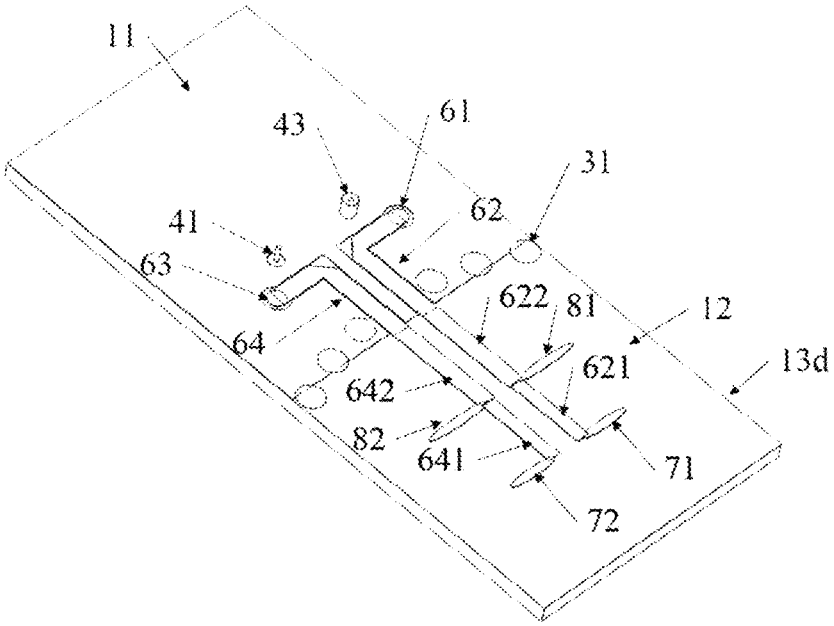

Distances between adjacent reflection pillars 31 of the reflector 3 may be completely equal or partially equal. To improve the reflection effect of the reflector 3, distances between adjacent reflection pillars 31 cannot be too long. In a case that a related component needs to penetrate space between two adjacent reflection pillars 31 of the reflector 3, the distance between the two adjacent reflection pillars 31 may be appropriately increased, and distances between the other adjacent reflection pillars 31 may be correspondingly reduced. FIG. 1, FIG. 3, and other figures show an implementation in which a distance between two reflection pillars 31 in the middle of the reflector 3 is larger, and distances between the other adjacent reflection pillars 31 are equal.

The following describes a disposing method of each component of the antenna element.

Figure 2:
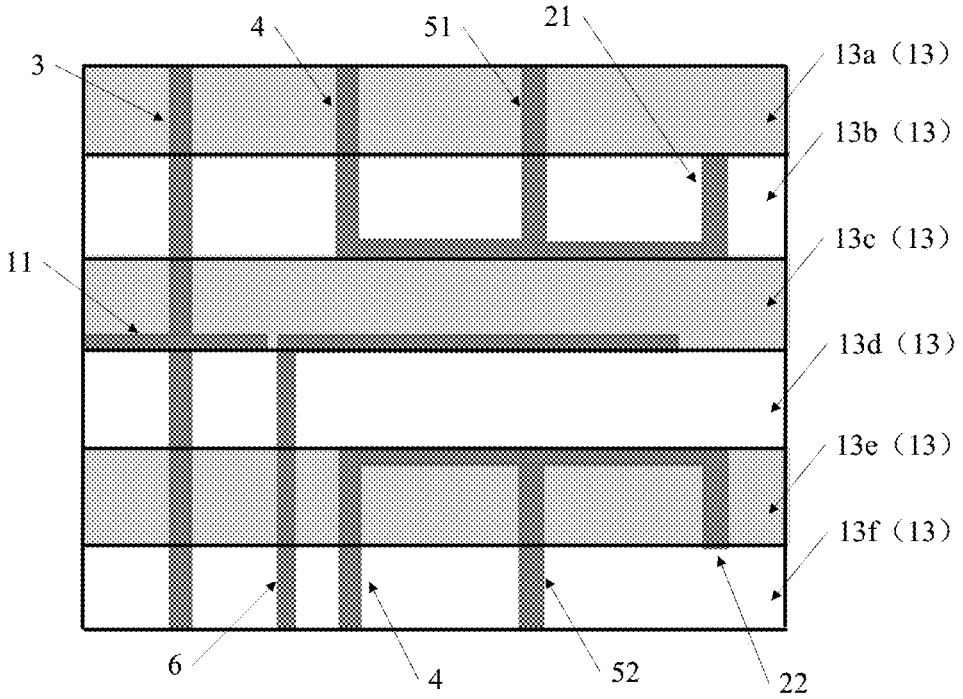
FIG. 2 is a schematic diagram of a cross-section structure of an antenna element according to an embodiment of the present disclosure.

Optionally, as shown in FIG. 2, the substrate 1 includes N dielectric plates 13, where N is greater than or equal to 5.

The first antenna branch 21 and the second antenna branch 22 are respectively disposed in two non-adjacent dielectric plates 13, and the first antenna branch 21 and the second antenna branch 22 respectively penetrate the corresponding dielectric plates 13.

The third antenna branch 51 and the fourth antenna branch 52 are respectively disposed in two groups of non-adjacent dielectric plates 13, the third antenna branch 51 and the fourth antenna branch 52 respectively penetrate the corresponding dielectric plates 13, and each group of dielectric plates 13 includes at least two adjacent dielectric plates 13.

The entire reflector 3 penetrates the N dielectric plates 13.

Optionally, all the reflection pillars 31 of the reflector 3 penetrate the N dielectric plates 13.

As the substrate 1 includes a plurality of dielectric plates 13, the first antenna branch 21, the second antenna branch 22, the third antenna branch 51, the fourth antenna branch 52, and the reflector 3 can be formed by separately processing corresponding dielectric plates 13. In this way, a manufacturing process of the antenna element can be simplified. In addition, as the substrate 1 includes the plurality of dielectric plates 13, the lengths of the first antenna branch 21, the second antenna branch 22, the third antenna branch 51, the fourth antenna branch 52, and the reflection pillars 31, a distance between the first antenna branch 21 and the second antenna branch 22, and a distance between the third antenna branch 51 and the fourth antenna branch 52 can be conveniently controlled. Particularly, the lengths of the first antenna branch 21, the second antenna branch 22, the third antenna branch 51, and the fourth antenna branch 52 can be controlled more precisely, thereby being approximately a quarter of a wavelength in a medium, so as to improve performance of the antenna element.

In addition, all the reflection pillars 31 of the reflector 3 penetrate the N dielectric plates 13, so that the first vertically polarized dipole antenna 2 and the second vertically polarized dipole antenna 5 are both located in a reflection area of the reflector 3, thereby further improving the reflection effect.

FIG. 2 shows an implementation in which the substrate 1 includes six dielectric plates 13, the first antenna branch 21 is disposed in a second dielectric plate 13*b*, the second antenna branch 22 is disposed in a fifth dielectric plate 13*e*, the third antenna branch 51 is disposed in a first dielectric plate 13*a* and the second dielectric plate 13*b*, and the fourth antenna branch 52 is disposed in the fifth dielectric plate 13*e* and a sixth dielectric plate 13*f*. In addition, the substrate 1 may alternatively include five dielectric plates 13, the first antenna branch 21 is disposed in a second dielectric plate 13*b*, the second antenna branch 22 is disposed in a fourth dielectric plate 13*d*, the third antenna branch 51 is disposed in a first dielectric plate 13*a* and the second dielectric plate 13*b*, and the fourth antenna branch 52 is disposed in the fourth dielectric plate 13*d* and a fifth dielectric plate 13*e*.

Optionally, the first antenna branch 21, the second antenna branch 22, the third antenna branch 51, and the fourth antenna branch 52 are respectively formed by metal pillars that penetrate corresponding dielectric plates 13.

All the reflection pillars 31 of the reflector 3 are formed by several metal pillars penetrating the N dielectric plates 13. For example, the dielectric plates 13 corresponding to the first antenna branch 21, the second antenna branch 22, the third antenna branch 51, and the fourth antenna branch 52 are all provided with through holes (not shown in the figures) perpendicularly penetrating the dielectric plates 13, and the first antenna branch 21, the second antenna branch 22, the third antenna branch 51, and the fourth antenna branch 52 are formed by metal pillars with which the through holes are filled. Several through holes perpendicularly penetrating the N dielectric plates 13 are formed in the N dielectric plates 13 along a parabola, and all the reflection pillars 31 of the reflector 3 are formed by metal pillars with which the several through holes are filled.

The first antenna branch 21, the second antenna branch 22, the third antenna branch 51, the fourth antenna branch 52, and the reflection pillars 31 are formed by punching holes in the dielectric plates 13 and disposing metal pillars in the holes. Therefore, a process is simple and mature and easy to implement, and nearly no additional production cost is added.

The antenna element in this embodiment of the present disclosure may be provided with only the first vertically polarized dipole antenna 2 and the second vertically polarized dipole antenna 5, thereby being used as a dual-frequency single-polarized dipole antenna. The antenna element in this embodiment of the present disclosure may alternatively be set to a dual-frequency dual-polarized dipole antenna. The following describes implementations of the dual-frequency dual-polarized dipole antenna.

As shown in FIG. 2 to FIG. 12, the antenna element includes:

a substrate 1, where the substrate 1 has a ground plate 11;

a first vertically polarized dipole antenna 2, where the first vertically polarized dipole antenna 2 includes a first antenna branch 21 and a second antenna branch 22, and the first antenna branch 21 and the second antenna branch 22 are disposed in the substrate 1 at an interval;

a second vertically polarized dipole antenna 5, where the second vertically polarized dipole antenna 5 includes a third antenna branch 51 and a fourth antenna branch 52, and the third antenna branch 51 and the fourth antenna branch 52 are disposed in the substrate 1 at an interval;

a first horizontally polarized dipole antenna 7, where the first horizontally polarized dipole antenna 7 includes a fifth antenna branch 71 and a sixth antenna branch 72, and the fifth antenna branch 71 and the sixth antenna branch 72 are disposed in the substrate 1 at an interval;

a second horizontally polarized dipole antenna 8, where the second horizontally polarized dipole antenna 8 includes a seventh antenna branch 81 and an eighth antenna branch 82, and the seventh antenna branch 81 and the eighth antenna branch 82 are disposed in the substrate at an interval;

a reflector 3, where the reflector 3 includes several reflection pillars 31, and the several reflection pillars 31 are arranged in the substrate 1 at intervals along a parabola;

a first feeding structure 4, where the first feeding structure 4 electrically connects each of the first antenna branch 21, the second antenna branch 22, the third antenna branch 51, and the fourth antenna branch 52 to the ground plate 11; and a second feeding structure 6, where the second feeding structure 6 electrically connects each of the fifth antenna branch 71, the sixth antenna branch 72, the seventh antenna branch 81, and the eighth antenna branch 82 to the ground plate 11.

The first antenna branch 21, the second antenna branch 22, the third antenna branch 51, the fourth antenna branch 52, the fifth antenna branch 71, the sixth antenna branch 72, the seventh antenna branch 81, and the eighth antenna branch 82 are all located on a focus side of the parabola.

Lengths of the first antenna branch 21 and the second antenna branch 22 are both less than lengths of the third antenna branch 51 and the fourth antenna branch 52.

Lengths of the fifth antenna branch 71 and the sixth antenna branch 72 are both less than lengths of the seventh antenna branch 81 and the eighth antenna branch 82.

The first antenna branch 21 and the second antenna branch 22 are respectively located on two sides of a first plane where the fifth antenna branch 71, the sixth antenna branch 72, the seventh antenna branch 81, and the eighth antenna branch 82 are located.

The third antenna branch 51 and the fourth antenna branch 52 are respectively located on two sides of the first plane where the fifth antenna branch 71, the sixth antenna branch 72, the seventh antenna branch 81, and the eighth antenna branch 82 are located.

The fifth antenna branch 71 and the sixth antenna branch 72 are respectively located on two sides of a second plane where the first antenna branch 21, the second antenna branch 22, the third antenna branch 51, and the fourth antenna branch 52 are located.

The seventh antenna branch 81 and the eighth antenna branch 82 are respectively located on two sides of the second plane where the first antenna branch 21, the second antenna branch 22, the third antenna branch 51, and the fourth antenna branch 52 are located.

It should be noted that, the foregoing related description of the dual-frequency single-polarized dipole antenna is still applicable to the dual-frequency dual-polarized dipole antenna, and a same beneficial effect can be achieved. To avoid repetition, details are not described herein again.

Optionally, the first plane where the fifth antenna branch 71, the sixth antenna branch 72, the seventh antenna branch 81, and the eighth antenna branch 82 are located is parallel to the substrate 1; and the second plane where the first antenna branch 21, the second antenna branch 22, the third antenna branch 51, and the fourth antenna branch 52 are located is perpendicular to the substrate 1.

The fifth antenna branch 71, the sixth antenna branch 72, the seventh antenna branch 81, and the eighth antenna branch 82 may be rectangular, triangular, or oval. Because shape changes of an oval are relatively gentle, when fifth antenna branch 71, the sixth antenna branch 72, the seventh antenna branch 81, and the eighth antenna branch 82 are oval, impedance changes of the antenna are relatively gentle, which is conducive to the expansion of a bandwidth of the first horizontally polarized dipole antenna 7 and the second horizontally polarized dipole antenna 8. The lengths of the fifth antenna branch 71, the sixth antenna branch 72, the seventh antenna branch 81, and the eighth antenna branch 82 are all approximately a quarter of a wavelength in a medium. The lengths of the fifth antenna branch 71, the sixth antenna branch 72, the seventh antenna branch 81, and the eighth antenna branch 82 may be set based on a millimeter-wave wavelength.

Because the lengths of the antenna branches of the first horizontally polarized dipole antenna 7 are less than the lengths of the antenna branches of the second horizontally polarized dipole antenna 8, the first horizontally polarized dipole antenna 7 corresponds to a high frequency, and the second horizontally polarized dipole antenna 8 corresponds to a low frequency. Assuming that reference frequencies are 28 GHz and 39 GHz, the first horizontally polarized dipole antenna 7 corresponds to the frequency of 39 GHz, and the second horizontally polarized dipole antenna 8 corresponds to the frequency of 28 GHz.

Figure 13:
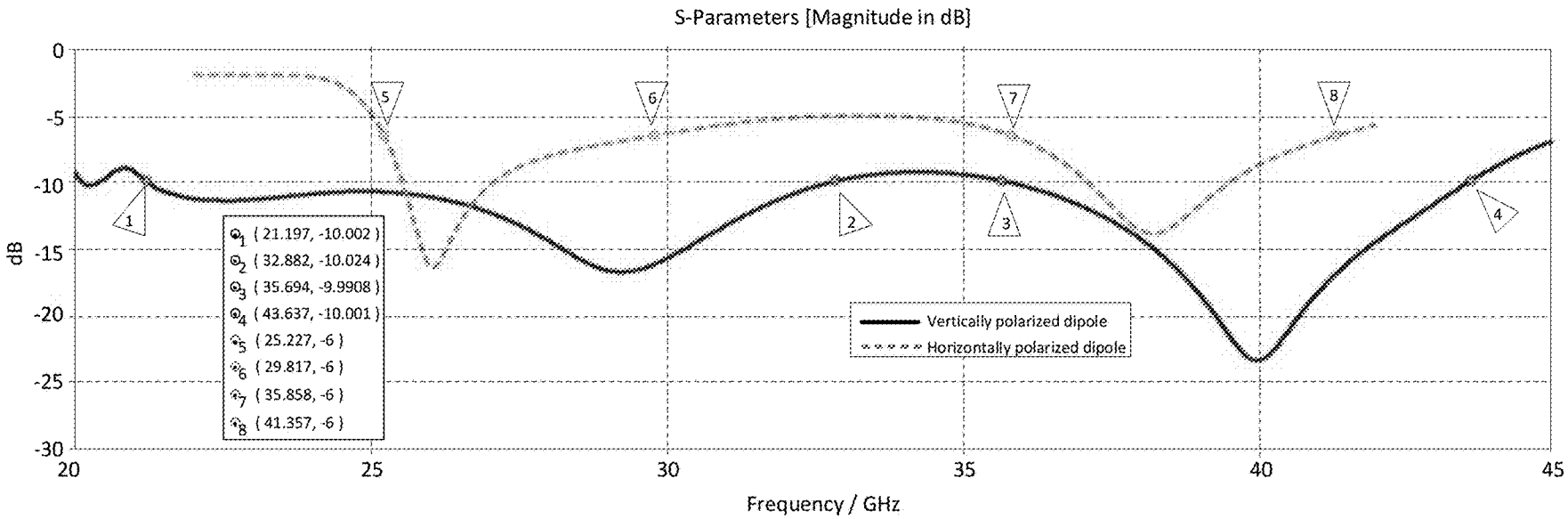
FIG. 13 is a simulated diagram of a reflection coefficient of an antenna element according to an embodiment of the present disclosure.
Figure 14:
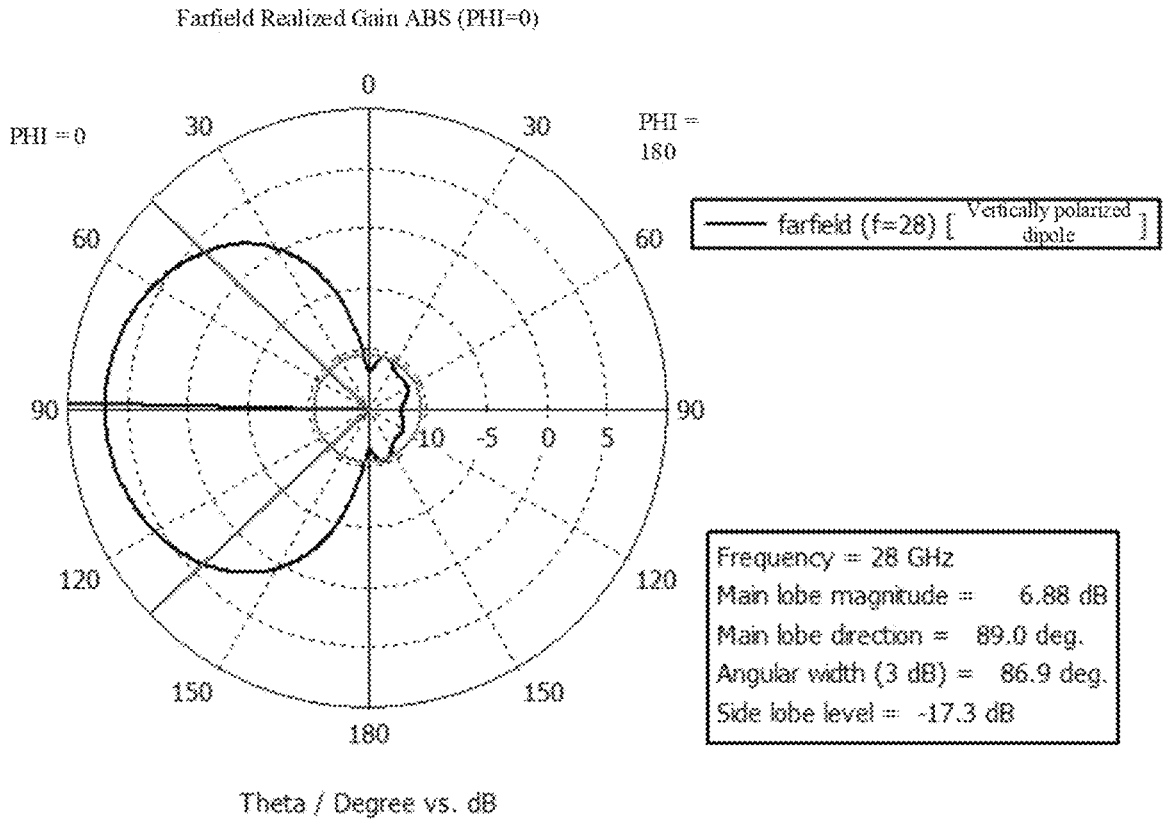
FIG. 14 is a radiation pattern of a 28-GHz vertically polarized dipole of an antenna element according to an embodiment of the present disclosure.
Figure 15:
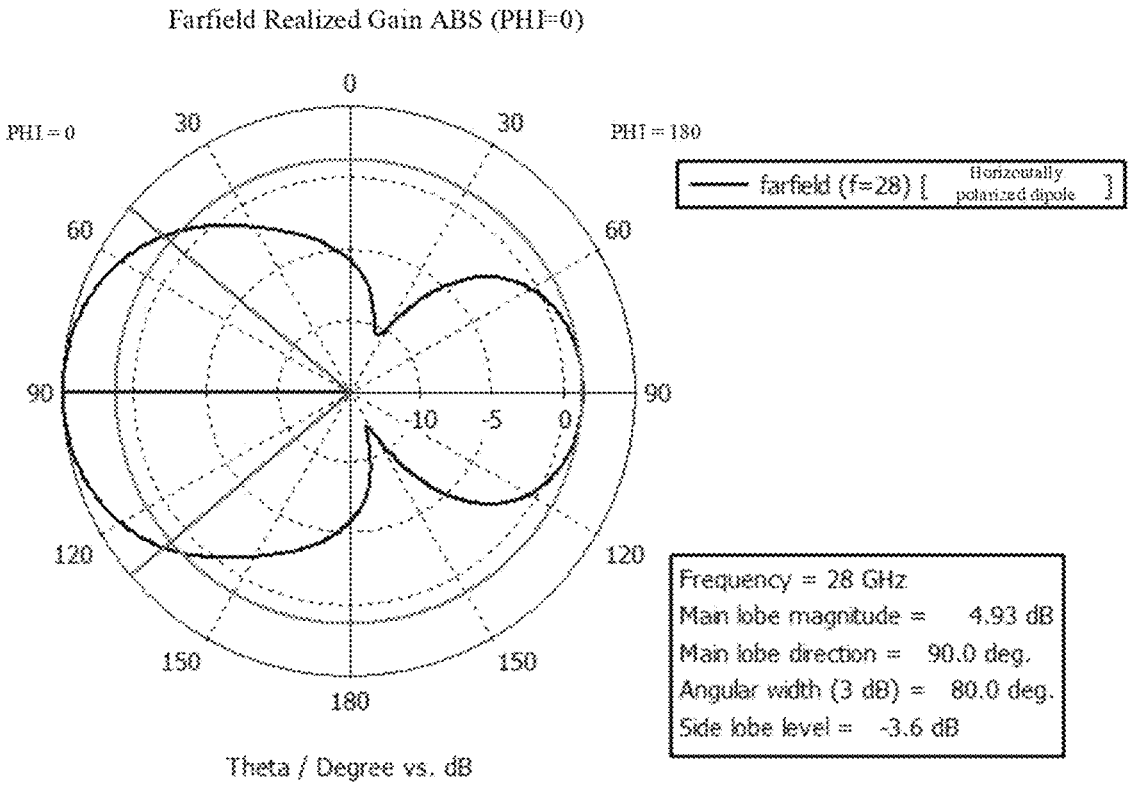
FIG. 15 is a radiation pattern of a 28-GHz horizontally polarized dipole of an antenna element according to an embodiment of the present disclosure.
Figure 16:
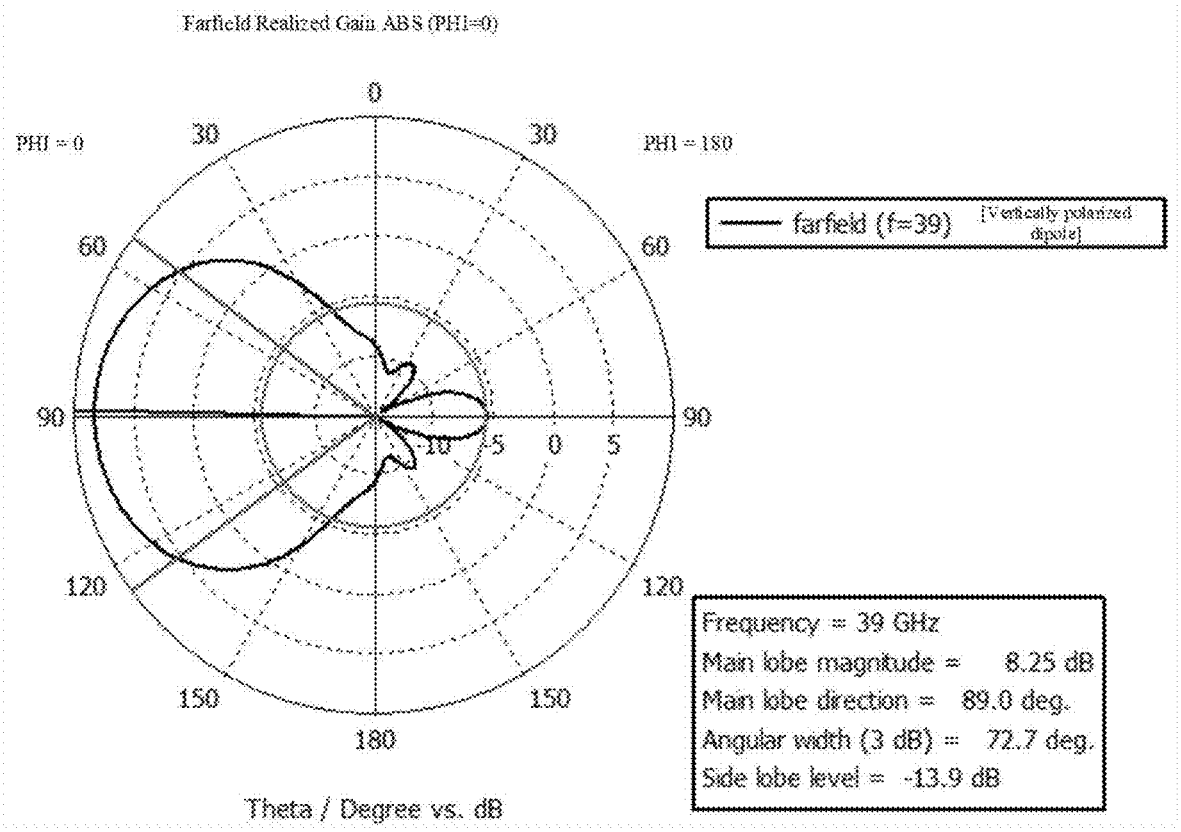
FIG. 16 is a radiation pattern of a 39-GHz vertically polarized dipole of an antenna element according to an embodiment of the present disclosure.
Figure 17:
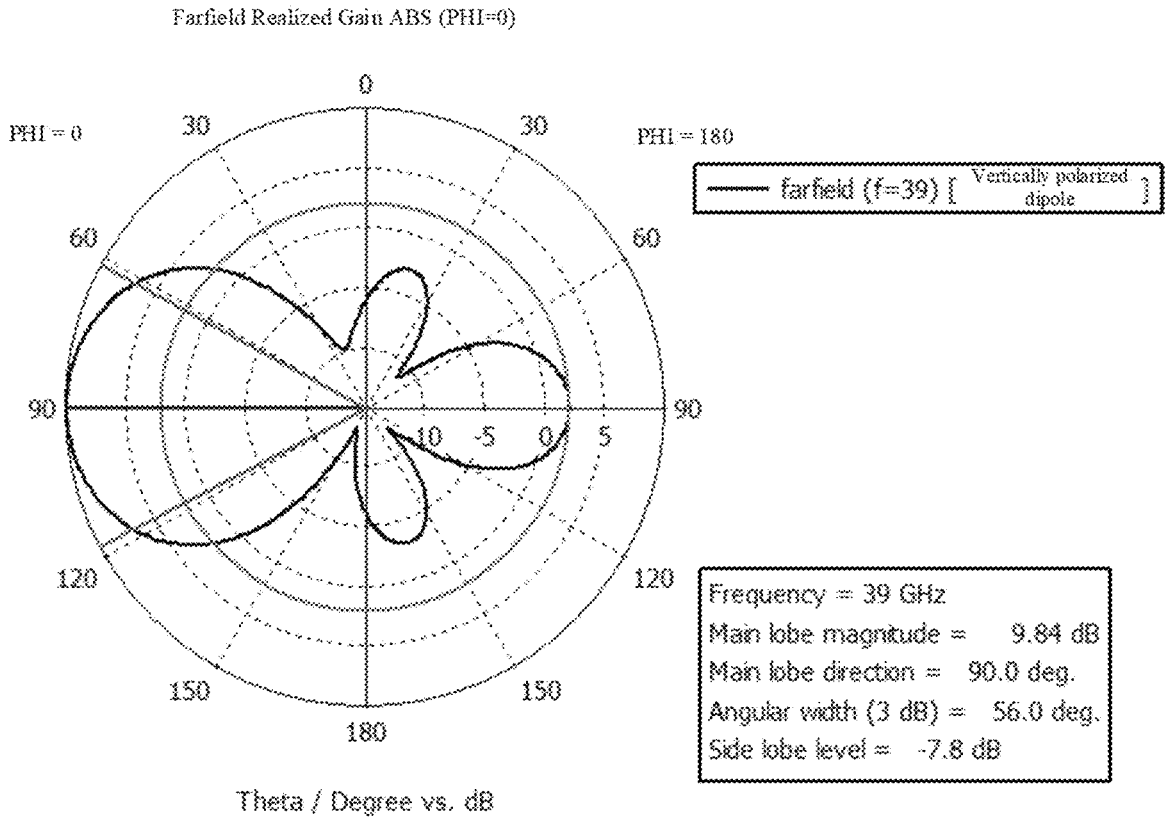
FIG. 17 is a radiation pattern of a 39-GHz horizontally polarized dipole of an antenna element according to an embodiment of the present disclosure.

FIG. 13 is a reflection coefficient diagram of the antenna element. Common bandwidths of the horizontally polarized dipole antennae and the vertically polarized dipole antennae range from 25.22 GHz to 29.81 GHz and from 35.85 GHz to 41.35 GHz when their S parameters are less than or equal to −6 dB, thereby basically covering the globally mainstream 5G millimeter-wave frequency bands n257, n261, and n260 that are defined by the 3GPP.

It should be noted that, in a case that the ground plate 11 is disposed in a partial area of the substrate 1, for example, the left-side area of the substrate 1, and the right-side area of the substrate 1 is the clearance area 12. The entire reflector 3 may be disposed in the area where the ground plate 11 is located. The first vertically polarized dipole antenna 2, the second vertically polarized dipole antenna 5, the first horizontally polarized dipole antenna 7, and the second horizontally polarized dipole antenna 8 may be disposed in the clearance area 12. The first feeding structure 4 and the second feeding structure 6 extend from the clearance area 12 to the area where the ground plate 11 is located.

The reflector 3 may be used as a reflector of the first vertically polarized dipole antenna 2 and the second vertically polarized dipole antenna 5. The reflector of the first horizontally polarized dipole antenna 7 and the second horizontally polarized dipole antenna 8 may be the ground plate 11 of the substrate 1, that is, the ground plate 11 of the substrate 1 may be used as the reflector of the first horizontally polarized dipole antenna 7 and the second horizontally polarized dipole antenna 8. To achieve a better reflection effect, the fifth antenna branch 71, the sixth antenna branch 72, the seventh antenna branch 81, and the eighth antenna branch 82 may be located on a plane where the ground plate 11 of the substrate 1 is located.

In this embodiment of the present disclosure, a dual-frequency vertical dipole antenna and a dual-frequency horizontal dipole antenna are combined, to implement design of a dual-frequency dual-polarized dipole antenna. In one aspect, a multiple-input multiple-output (MIMO) function can be implemented, thereby increasing a data transmission rate. In another aspect, a wireless connection capability of the antenna can be improved, thereby reducing a probability of communication disconnection, and improving communication effects and user experience.

Optionally, the first horizontally polarized dipole antenna 7 and the second horizontally polarized dipole antenna 8 are both located in the area between the first vertically polarized dipole antenna 2 and the reflector 3.

In this embodiment of the present disclosure, because the vertical dipole antenna and the horizontal dipole antenna are staggered in a vertical direction (namely, a direction perpendicular to the substrate 1), a position relationship between the horizontal dipole antenna and the vertical dipole antenna in a horizontal direction (namely, a direction parallel to the substrate 1) may not be limited. For example, the entire horizontal dipole antenna may be located in an area between the vertical dipole antenna and the reflector 3; or the entire vertical dipole antenna may be located in an area between the horizontal dipole antenna and the reflector 3; or the entire horizontal dipole antenna and the entire vertical dipole antenna may be respectively located on two same vertical planes.

Figure 9:
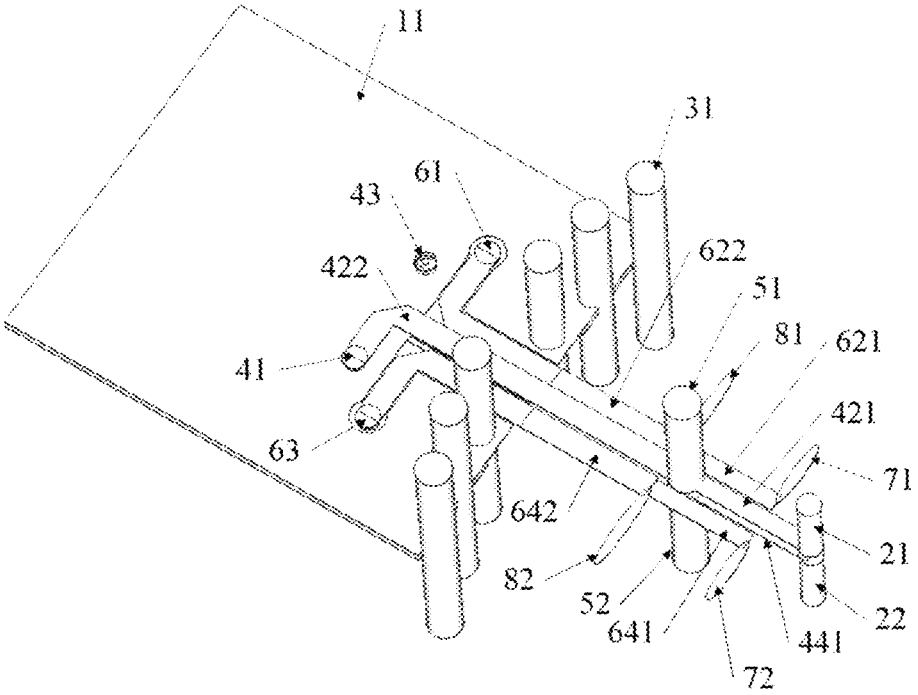
Figure 10:
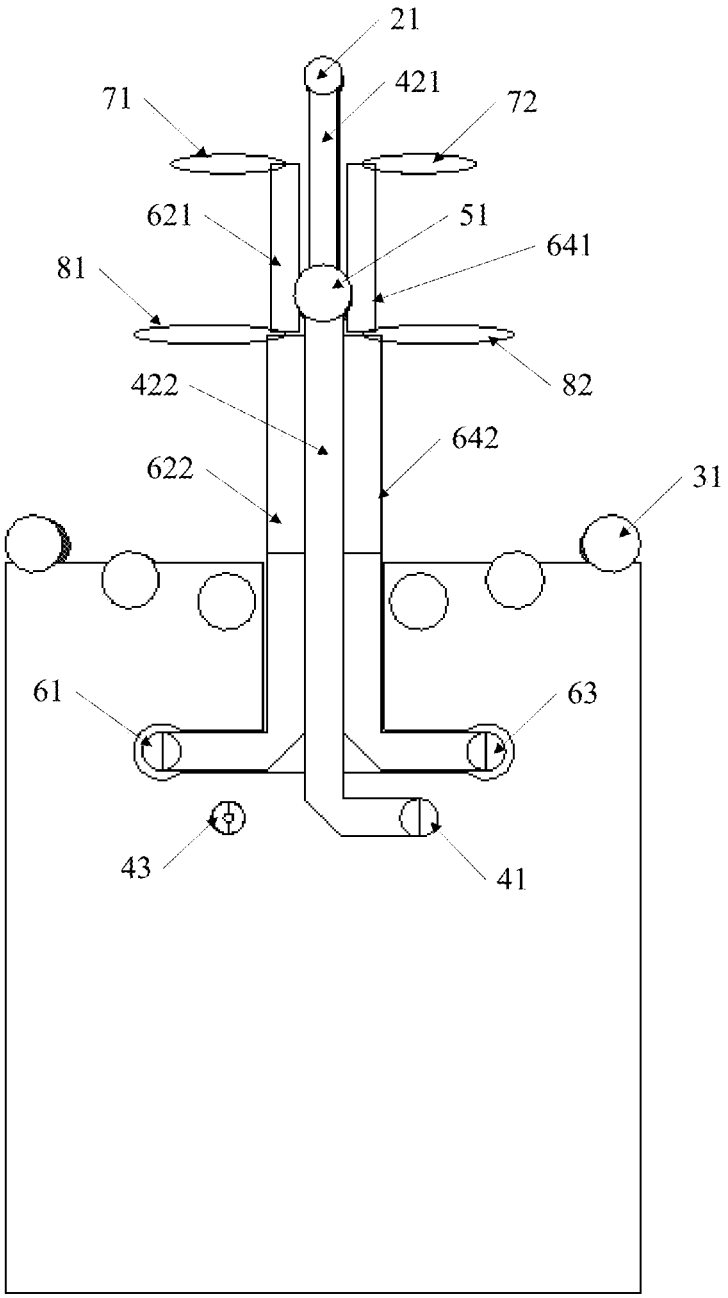
FIG. 10 is a schematic top view of an internal structure of an antenna element according to an embodiment of the present disclosure.
Figure 11:
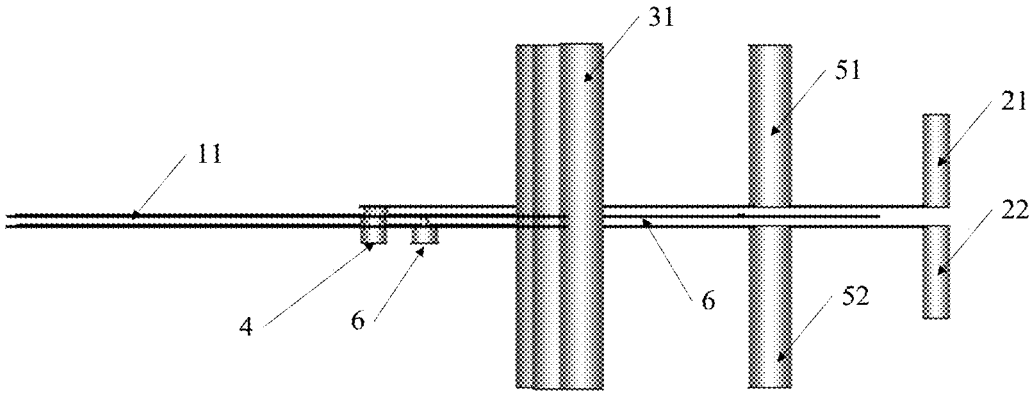
FIG. 11 is a schematic side view of an internal structure of an antenna element according to an embodiment of the present disclosure.
Figure 12:
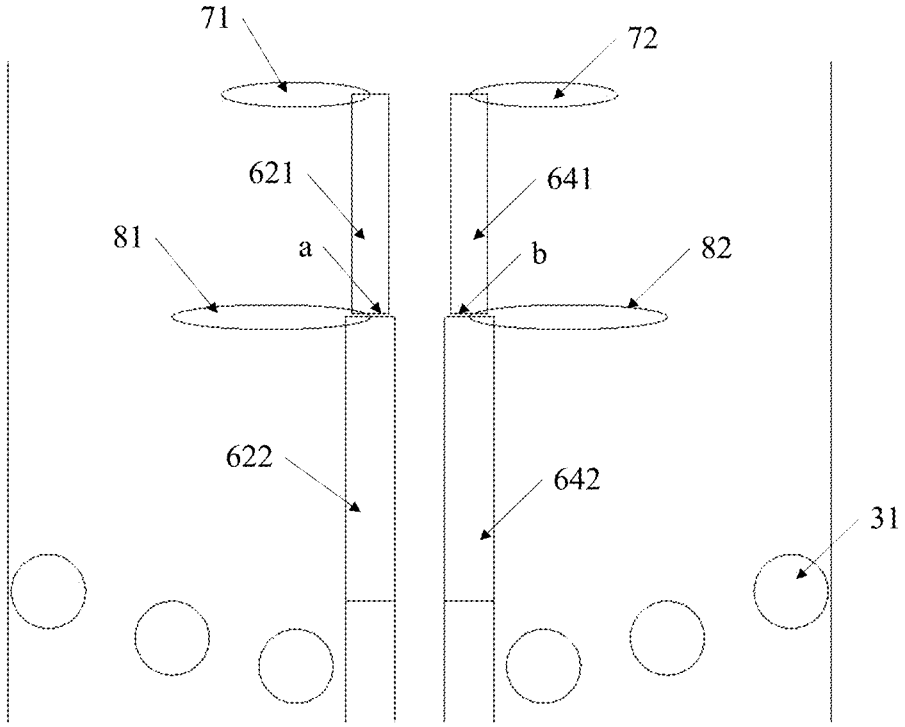
FIG. 12 is a partial schematic diagram corresponding to FIG. 10.

FIG. 9 and FIG. 10 show an implementation in which the first horizontally polarized dipole antenna 7 and the second horizontally polarized dipole antenna 8 are both located in the area between the first vertically polarized dipole antenna 2 and the reflector 3. In this implementation, space that is of the clearance area 12 and that is occupied by the first horizontally polarized dipole antenna 7 and the second horizontally polarized dipole antenna 8 can be reduced.

Optionally, the second horizontally polarized dipole antenna 8 is located in an area between the first horizontally polarized dipole antenna 7 and the reflector 3.

Because the lengths of the antenna branches of the first horizontally polarized dipole antenna 7 are less than the lengths of the antenna branches of the second horizontally polarized dipole antenna 8, the second horizontally polarized dipole antenna 8 is disposed in the area between the first horizontally polarized dipole antenna 7 and the reflector 3, so that the antenna branches of the second horizontally polarized dipole antenna 8 can serve as a reflector of the first horizontally polarized dipole antenna 7, thereby further improving the end-fire performance of the entire antenna element.

Optionally, the first antenna branch 21 and the second antenna branch 22 are symmetrical about the first plane, and the third antenna branch 51 and the fourth antenna branch 52 are symmetrical about the first plane.

The fifth antenna branch 71 and the sixth antenna branch 72 are symmetrical about the second plane, and the seventh antenna branch 81 and the eighth antenna branch 82 are symmetrical about the second plane.

The first plane is a plane where the fifth antenna branch 71, the sixth antenna branch 72, the seventh antenna branch 81, and the eighth antenna branch 82 are located; and the second plane is a plane where the first antenna branch 21, the second antenna branch 22, the third antenna branch 51, and the fourth antenna branch 52 are located.

Optionally, the first plane where the fifth antenna branch 71, the sixth antenna branch 72, the seventh antenna branch 81, and the eighth antenna branch 82 are located is parallel to the substrate 1.

The perpendicular distance between the first antenna branch 21 and the first plane is equal to that between the third antenna branch 51 and the first plane.

Correspondingly, the perpendicular distance between the second antenna branch 22 and the first plane is equal to that between the fourth antenna branch 52 and the first plane.

In this way, it can be learned from the entire structure that, the antenna branches of the dual-frequency horizontally polarized dipole antenna are located in the middle of the dual-frequency vertically polarized dipole antenna; and the antenna branches of the dual-frequency vertically polarized dipole antenna are located in the middle of the horizontally polarized dipole antenna. Therefore, the entire structure is kept strictly symmetrical in a horizontal direction and a vertical direction, which can prevent angle offset of the radiation patterns in a primary radiation direction.

FIG. 14 to FIG. 17 respectively show radiation patterns of the dual-frequency dual-polarized dipole antenna at frequencies of 28 GHz and 39 GHz, where the radiation patterns are all end-fire radiation patterns with less back-end radiation.

The following describes disposing methods of related feeding structures of the antenna element.

As shown in FIG. 3 to FIG. 12, the first feeding structure 4 includes:

a first feeding point 41, where the first feeding point 41 is electrically connected to the ground plate 11;

a first feeder 42, where the first antenna branch 21 and the third antenna branch 51 are electrically connected to the first feeding point 41 by the first feeder 42;

a second feeding point 43, where the second feeding point 43 is electrically connected to the ground plate 11; and a second feeder 44, where the second antenna branch 22 and the fourth antenna branch 52 are electrically connected to the second feeding point 43 by the second feeder 44; and the second feeding structure 6 includes:

a third feeding point 61, where the third feeding point 61 is electrically connected to the ground plate 11;

a third feeder 62, where the fifth antenna branch 71 and the seventh antenna branch 81 are electrically connected to the third feeding point 61 by the third feeder 62;

a fourth feeding point 63, where the fourth feeding point 63 is electrically connected to the ground plate 11; and a fourth feeder 64, where the sixth antenna branch 72 and the eighth antenna branch 82 are electrically connected to the fourth feeding point 63 by the fourth feeder 64.

The feeding structures of the dipole antennae, namely, the first feeding structure 4 and the second feeding structure 6, both use double-ended feeding. Signal sources connected to two feeders of each feeding structure have equal amplitudes and a 180-degree phase difference, that is, all the dipole antennae use a differential feeding method. Differential feeding can be used to improve common mode rejection capabilities and anti-interference capabilities of the antennae. In addition, end-to-end isolation of differentiation and purity of polarization can be improved. In addition, radiation power of the antennae can be higher than that of an antenna using a single-ended feeding structure.

It should be noted that, for a single-polarized antenna element, namely, an antenna element including only the first vertically polarized dipole antenna 2 and the second vertically polarized dipole antenna 5, the first feeding structure 4 may also use the foregoing double-ended feeding structure. This is easy to understand. To avoid repetition, details are not described herein again.

Optionally, the antenna branches of the first vertically polarized dipole antenna 2, the second vertically polarized dipole antenna 5, the first horizontally polarized dipole antenna 7, and the second horizontally polarized dipole antenna 8 all use coaxial-line differential feeding.

The third feeder 62 and the fourth feeder 64 are mainly formed by connecting coaxial lines to a coplanar waveguide (CPW) and then respectively connecting the coaxial lines to the fifth antenna branch 71, the seventh antenna branch 81, the sixth antenna branch 72, and the eighth antenna branch 82.

In addition, in a case that a multilayer circuit substrate (LTCC) process is used for processing, in other words, when the substrate 1 includes a plurality of dielectric plates 13, a radio frequency integrated circuit (RFIC) chip can be buried in the dielectric plates 13, to directly feed electricity to the first vertically polarized dipole antenna 2 and the second vertically polarized dipole antenna 5, thereby shortening lengths of the first feeder 42 and the second feeder 44 to reduce loss.

As mentioned above, in order to reduce horizontal space that is of the area where the ground plate 11 is located and that is occupied by the entire reflector 3, for reserving more space of the area where the ground plate 11 is located for other components, the entire reflector 3 may be disposed in an edge area of the ground plate 11 close to the clearance area 12.

In the foregoing disposing methods, the first feeding point 41 and the second feeding point 43 are disposed on one side, far away from the first vertically polarized dipole antenna 2, of the reflector 3; and the third feeding point 61 and the fourth feeding point 63 are disposed on one side, far away from the first horizontally polarized dipole antenna 7, of the reflector 3.

In this case, the first feeder 42, the second feeder 44, the third feeder 62, and the fourth feeder 64 all need to penetrate gaps between the reflection pillars 31 of the reflector 3. Therefore, the gaps between the reflection pillars 31 can be flexibly adjusted based on an arrangement method of the feeders.

Optionally, the first feeder 42, the second feeder 44, the third feeder 62, and the fourth feeder 64 separately penetrate a gap between two reflection pillars 31 in the middle of the reflector 3 to reach corresponding feeding points. Therefore, the gap between the two adjacent reflection pillars 31 in the middle of the reflector 3 can be appropriately increased, to ensure that the feeders can directly penetrate the gap.

Optionally, in a horizontal direction (namely, a direction parallel to the substrate 1), because the antenna branches of the first vertically polarized dipole antenna 2 and the second vertically polarized dipole antenna 5 are both disposed at a middle position between the two antenna branches of the first horizontally polarized dipole antenna 7, the first feeder 42 and the second feeder 44 are both disposed between the third feeder 62 and the fourth feeder 64 in the horizontal direction.

Optionally, the third feeder 62 includes a first feeder segment 621 and a second feeder segment 622, the first feeder segment 621 is connected to the fifth antenna branch 71 and the seventh antenna branch 81, and the second feeder segment 622 is connected to the seventh antenna branch 81 and the third feeding point 61.

The fourth feeder 64 includes a third feeder segment 641 and a fourth feeder segment 642, the third feeder segment 641 is connected to the sixth antenna branch 72 and the eighth antenna branch 82, and the fourth feeder segment 642 is connected to the eighth antenna branch 82 and the fourth feeding point 63.

Optionally, a width of the first feeder segment 621 is less than that of the second feeder segment 622; and a width of the third feeder segment 641 is less than that of the fourth feeder segment 642.

In this way, impedance of the first horizontally polarized dipole antenna 7 can match that of the second horizontally polarized dipole antenna 8.

Optionally, there is a gap a between the first feeder segment 621 and the second feeder segment 622; and there is a gap b between the third feeder segment 641 and the fourth feeder segment 642.

The gaps a and b are set so that capacitance can be introduced, which facilitates impedance matching between the first horizontally polarized dipole antenna 7 and the second horizontally polarized dipole antenna 8.

Optionally, the first feeder 42 includes a fifth feeder segment 421 and a sixth feeder segment 422, the fifth feeder segment 421 is connected to the first antenna branch 21 and the third antenna branch 51, and the sixth feeder segment 422 is connected to the third antenna branch 51 and the first feeding point 41.

The second feeder 44 includes a seventh feeder segment 441 and an eighth feeder segment 442, the seventh feeder segment 441 is connected to the second antenna branch 22 and the fourth antenna branch 52, and the eighth feeder segment 442 is connected to the fourth antenna branch 52 and the second feeding point 43.

A width of the fifth feeder segment 421 is less than that of the sixth feeder segment 422.

A width of the seventh feeder segment 441 is less than that of the eighth feeder segment 442.

In the foregoing disposing methods, the impedance of the first vertically polarized dipole antenna 2 can match that of the second vertically polarized dipole antenna 5.

The following provides an implementation in which the substrate 1 includes a plurality of dielectric plates 13. The following implementation can be used for disposing each component of the foregoing dual-frequency dual-polarized dipole antenna.

As shown in FIG. 2, the substrate 1 includes six dielectric plates 13.

The first antenna branch 21 is disposed in a first dielectric plate 13*a* and penetrates the first dielectric plate 13*a*.

The third antenna branch 51 is disposed in the first dielectric plate 13*a* and a second dielectric plate 13*b*, and penetrates the first dielectric plate 13*a* and the second dielectric plate 13*b*.

The first feeder 42 is disposed on a surface of a third dielectric plate 13*c* close to the second dielectric plate 13*b*.

The fifth antenna branch 71, the sixth antenna branch 72, the seventh antenna branch 81, the eighth antenna branch 82, the third feeder 62, the fourth feeder 64, and the ground plate 11 are all disposed on a surface of a fourth dielectric plate 13*d* close to the third dielectric plate 13*c*.

The second feeder 44 is disposed on a surface of a fifth dielectric plate 13*e* close to the fourth dielectric plate 13*d*.

The second antenna branch 22 is disposed in the fifth dielectric plate 13*e* and penetrates the fifth dielectric plate 13*e*.

The fourth antenna branch 52 is disposed in the fifth dielectric plate 13*e* and a sixth dielectric plate 13*f*, and penetrates the fifth dielectric plate 13*e* and the sixth dielectric plate 13*f*.

The reflector 3 penetrates four dielectric plates 13, that is, the reflector 3 penetrates the first dielectric plate 13*a* to the sixth dielectric plate 13*f*.

Because the fifth antenna branch 71, the sixth antenna branch 72, the seventh antenna branch 81, the eighth antenna branch 82, and the ground plate 11 are all disposed on a same surface of a same dielectric plate 13, the ground plate 11 can be used as a reflector of the fifth antenna branch 71, the sixth antenna branch 72, the seventh antenna branch 81, and the eighth antenna branch 82, which can better improve reflection performance of the reflector.

Figure 7:
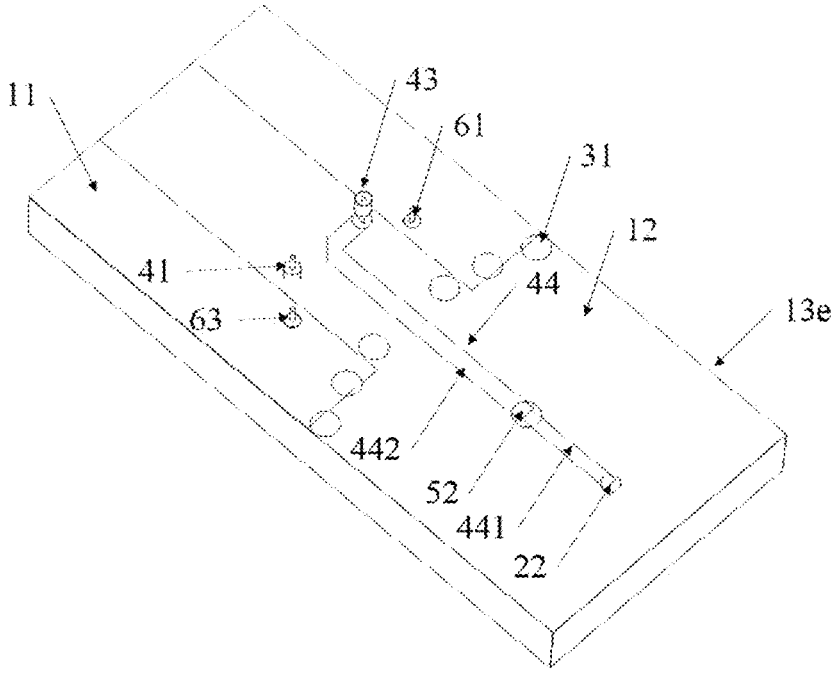
Figure 8:
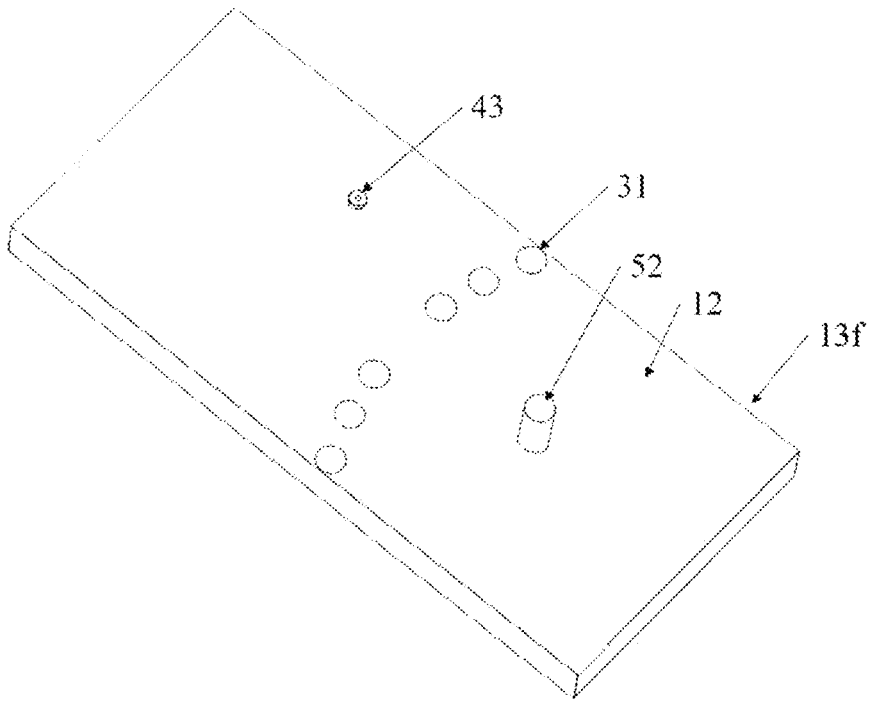

It should be noted that, in this implementation, the ground plate 11 is disposed not only on the surface of the fourth dielectric plate 13*d* close to the third dielectric plate 13*c*, but also on the surface of the fifth dielectric plate 13*e* close to the fourth dielectric plate 13*d*, as shown in FIG. 7. To ensure the symmetry between the ground plate 11 and each antenna branch and improve working performance of each antenna branch, the ground plate 11 may be disposed only on the surface of the fourth dielectric plate 13*d* close to the third dielectric plate 13*c*.

In addition, since the substrate 1 is designed to have a structure of a plurality of dielectric plates 13, the dual-polarized dipole antenna can be endowed with higher symmetry by controlling the thickness of each dielectric plate 13. The process is simple and easy to implement.

Optionally, all the reflection pillars 31 of the reflector 3 penetrate the first dielectric plate 13*a* to the sixth dielectric plate 13*f*.

In this embodiment of the present disclosure, for a dual-frequency single-polarized antenna element, namely, an antenna element including only the first vertically polarized dipole antenna 2 and the second vertically polarized dipole antenna 5, the first feeding structure 4 may further use the following single-ended feeding structure, in addition to the foregoing double-ended feeding structure.

Figure 18:
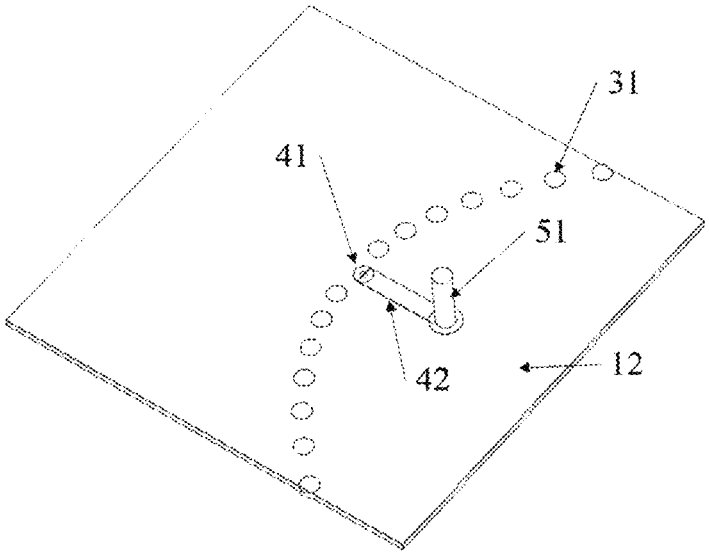
FIG. 18 to FIG. 20 are schematic exploded diagrams of a partial structure of another antenna element according to an embodiment of the present disclosure.
Figure 19:
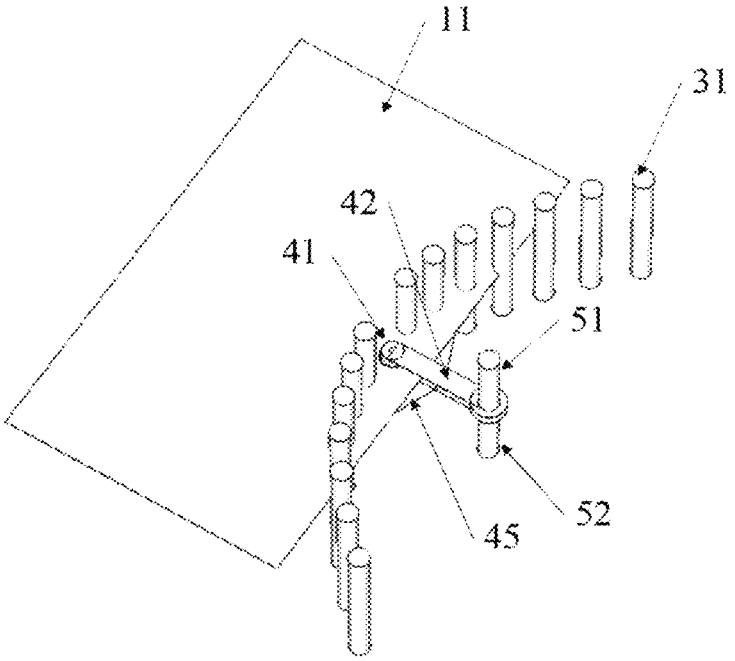
Figure 20:
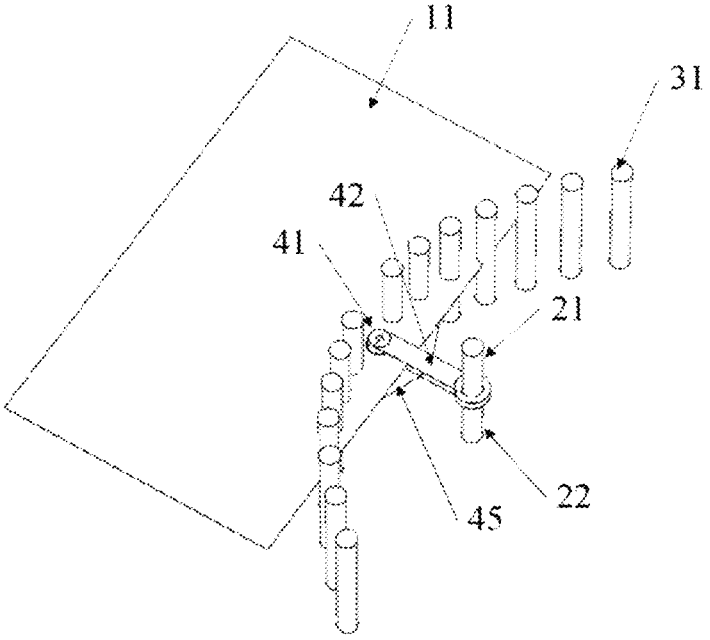

As shown in FIG. 18 to FIG. 20, the first feeding structure 4 includes:

a first feeding point 41, where the first feeding point 41 is electrically connected to the ground plate 11;

a first feeder 42, where the first antenna branch 21 and the third antenna branch 51 are electrically connected to the first feeding point 41 by the first feeder 42; and a second feeder 43, where the second feeder 43 is connected to each of the second antenna branch 22 and the fourth antenna branch 52, and is electrically connected to the ground plate 11 by a trapezoidal balun structure 45, where the first feeder 42 is coupled to the second feeder 43.

Owing to the trapezoidal balun structure 45 with an equal-amplitude and inverse-phase, the foregoing single-ended feeding structure can implement differential feeding performance.

In this embodiment of the present disclosure, a feeding structure of the first vertically polarized dipole antenna 2 is adjusted, that is, the second antenna branch 22 of the first vertically polarized dipole antenna 2 is directly grounded via the trapezoidal balun structure 45, so that only single-ended feeding needs to be used to feed electricity to the first antenna branch 21 of the first vertically polarized dipole antenna 2. Therefore, one channel can be eliminated to reduce costs.

It should be noted that, FIG. 18 to FIG. 20 do not show a related structure of the first vertically polarized dipole antenna 2. For a disposing method of the related structure, refer to remaining descriptions or accompanying drawings.

The following provides an implementation in which the substrate 1 includes a plurality of dielectric plates 13. The following implementation can be used for disposing each component of the foregoing single-polarized dipole antenna.

The substrate 1 includes five dielectric plates.

The first antenna branch 21 is disposed in a first dielectric plate and penetrates the first dielectric plate.

The third antenna branch 51 is disposed in the first dielectric plate and a second dielectric plate, and penetrates the first dielectric plate and the second dielectric plate.

The first feeder 42 is disposed on a surface of a third dielectric plate close to the second dielectric plate.

The second feeder 44, the trapezoidal balun structure 45, and the ground plate 11 are all disposed on the surface of the third dielectric plate close to the second dielectric plate.

The second antenna branch 22 is disposed in a fourth dielectric plate and penetrates the fourth dielectric plate.

The fourth antenna branch 52 is disposed in the fourth dielectric plate and a fifth dielectric plate, and penetrates the fourth dielectric plate and the fifth dielectric plate.

The reflector 3 penetrates the five dielectric plates.

It should be noted that, since the foregoing implementations are easy to understand, specific illustrations are not given in this embodiment of the present disclosure.

The antenna element in this embodiment of the present disclosure can be applied to a wireless metropolitan area network (WMAN), a wireless wide area network (WWAN), a wireless local area network (WLAN), a wireless personal area network (WPAN), multiple-input multiple-output (MIMO), radio frequency identification (RFID), near field communication (NFC), wireless power consortium (WPC), frequency modulation (FM), and other wireless communication scenarios. The antenna element in this embodiment of the present disclosure can also be applied to regulatory tests, design, and application of the compatibility of an SAR, an HAC, and other wearable electronic devices related to human safety and health (such as a hearing aid or a cardiac pacemaker).

An embodiment of the present disclosure further relates to an electronic device, including the antenna element provided in any of the embodiments of the present disclosure.

For implementations of the antenna element in the electronic device, refer to the foregoing descriptions, and a same technical effect can be achieved. To avoid repetition, details are not described herein again.

Figure 21:
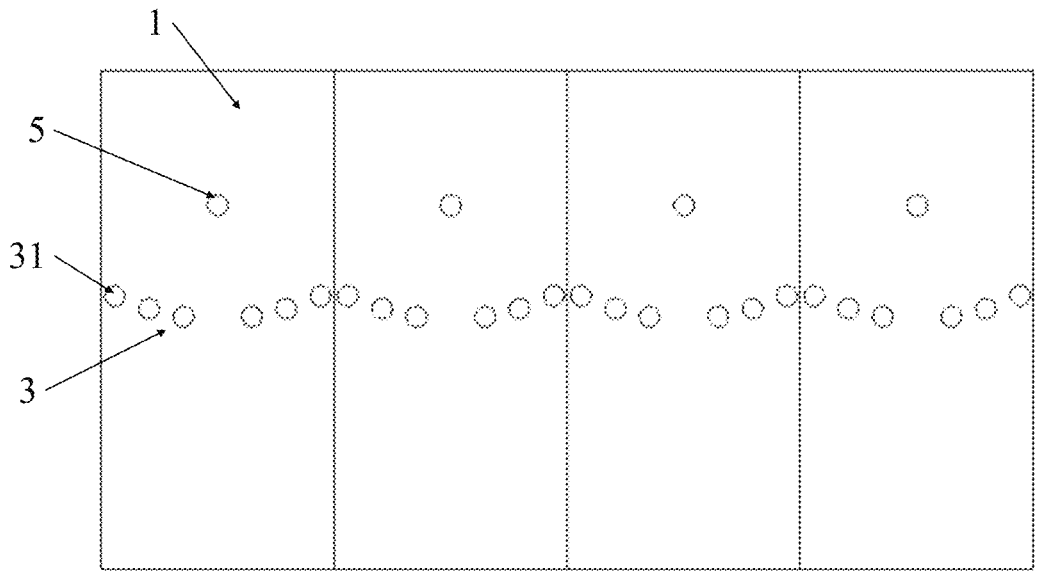
FIG. 21 is a first schematic structural diagram of an antenna array according to an embodiment of the present disclosure.

Optionally, as shown in FIG. 21, the quantity of the antenna elements is greater than or equal to 2, and the antenna elements are sequentially arranged to form an antenna array.

Figure 22:
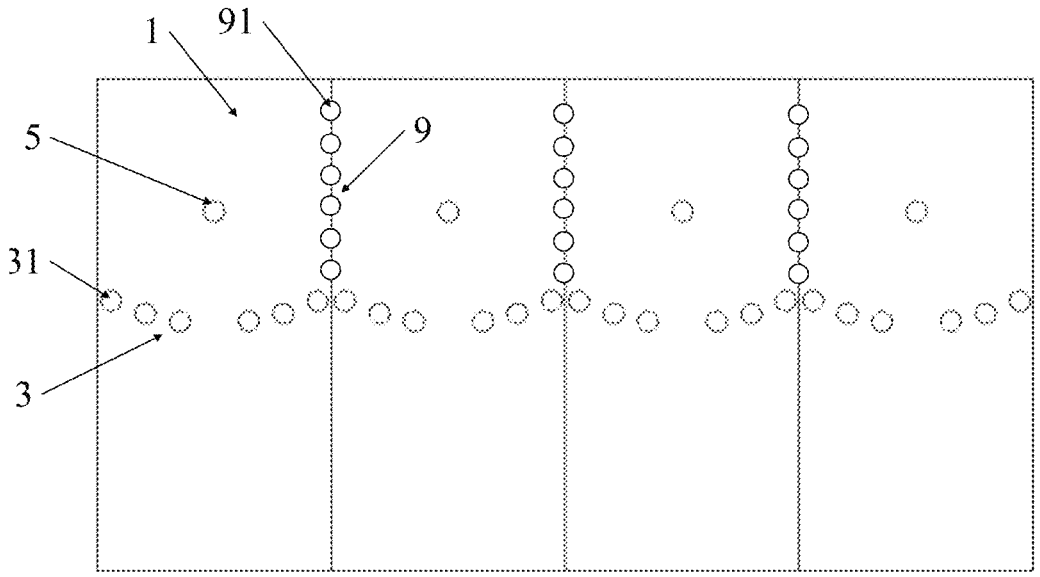
FIG. 22 is a second schematic structural diagram of an antenna array according to an embodiment of the present disclosure.

Optionally, as shown in FIG. 22, an isolator 9 is disposed between every two adjacent antenna elements.

As the isolator 9 is disposed between every two adjacent antenna elements, intercoupling between the adjacent antenna elements can be effectively reduced, thereby guaranteeing working performance of the antenna array.

Optionally, the isolator 9 includes several isolation pillars 91 arranged at intervals. The isolation pillars 91 are perpendicular to the substrate 1 and penetrate the substrate 1.

The foregoing electronic device may be a computer, a mobile phone, a tablet computer, a laptop computer, a personal digital assistant (PDA), a mobile Internet device (MID), a wearable device, an e-book reader, a navigator, a digital camera, or the like.

The foregoing descriptions are merely specific implementations of the present disclosure, but are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the protection scope of the claims.

What is claimed is:

1. An antenna element, comprising:

a substrate, wherein the substrate has a ground plate;

a first vertically polarized dipole antenna, wherein the first vertically polarized dipole antenna comprises a first antenna branch and a second antenna branch, and the first antenna branch and the second antenna branch are disposed in the substrate at an interval;

a second vertically polarized dipole antenna, wherein the second vertically polarized dipole antenna comprises a third antenna branch and a fourth antenna branch, and the third antenna branch and the fourth antenna branch are disposed in the substrate at an interval;

a reflector, wherein the reflector comprises several reflection pillars, and the several reflection pillars are arranged in the substrate at intervals along a parabola; and a first feeding structure, wherein the first feeding structure electrically connects each of the first antenna branch, the second antenna branch, the third antenna branch, and the fourth antenna branch to the ground plate, wherein the first antenna branch, the second antenna branch, the third antenna branch, and the fourth antenna branch are all located on a focus side of the parabola; and lengths of the first antenna branch and the second antenna branch are both less than lengths of the third antenna branch and the fourth antenna branch.

2. The antenna element according to claim 1, wherein the second vertically polarized dipole antenna is located in an area between the first vertically polarized dipole antenna and the reflector.

3. The antenna element according to claim 1, wherein cross section dimensions of the antenna branches of the first vertically polarized dipole antenna are less than cross section dimensions of the antenna branches of the second vertically polarized dipole antenna.

4. The antenna element according to claim 1, wherein the substrate comprises N dielectric plates, and N is greater than or equal to 5;

the first antenna branch and the second antenna branch are respectively disposed in two non-adjacent dielectric plates, and the first antenna branch and the second antenna branch respectively penetrate corresponding dielectric plates;

the third antenna branch and the fourth antenna branch are respectively disposed in two groups of non-adjacent dielectric plates, the third antenna branch and the fourth antenna branch respectively penetrate corresponding dielectric plates, and each group of dielectric plates comprises at least two adjacent dielectric plates; and all the several reflection pillars penetrate the N dielectric plates.

5. The antenna element according to claim 1, further comprising:

a first horizontally polarized dipole antenna, wherein the first horizontally polarized dipole antenna comprises a fifth antenna branch and a sixth antenna branch, and the fifth antenna branch and the sixth antenna branch are disposed in the substrate at an interval;

a second horizontally polarized dipole antenna, wherein the second horizontally polarized dipole antenna comprises a seventh antenna branch and an eighth antenna branch, and the seventh antenna branch and the eighth antenna branch are disposed in the substrate at an interval; and a second feeding structure, wherein the second feeding structure electrically connects each of the fifth antenna branch, the sixth antenna branch, the seventh antenna branch, and the eighth antenna branch to the ground plate, wherein the fifth antenna branch, the sixth antenna branch, the seventh antenna branch, and the eighth antenna branch are all located on the focus side of the parabola;

lengths of the fifth antenna branch and the sixth antenna branch are both less than lengths of the seventh antenna branch and the eighth antenna branch;

the first antenna branch and the second antenna branch are respectively located on two sides of a first plane where the fifth antenna branch, the sixth antenna branch, the seventh antenna branch, and the eighth antenna branch are located;

the third antenna branch and the fourth antenna branch are respectively located on two sides of the first plane where the fifth antenna branch, the sixth antenna branch, the seventh antenna branch, and the eighth antenna branch are located;

the fifth antenna branch and the sixth antenna branch are respectively located on two sides of a second plane where the first antenna branch, the second antenna branch, the third antenna branch, and the fourth antenna branch are located; and the seventh antenna branch and the eighth antenna branch are respectively located on two sides of the second plane where the first antenna branch, the second antenna branch, the third antenna branch, and the fourth antenna branch are located.

6. The antenna element according to claim 5, wherein the first antenna branch and the second antenna branch are symmetrical about the first plane, and the third antenna branch and the fourth antenna branch are symmetrical about the first plane; and the fifth antenna branch and the sixth antenna branch are symmetrical about the second plane, and the seventh antenna branch and the eighth antenna branch are symmetrical about the second plane.

7. The antenna element according to claim 5, wherein the first horizontally polarized dipole antenna and the second horizontally polarized dipole antenna are both located in the area between the first vertically polarized dipole antenna and the reflector.

8. The antenna element according to claim 5, wherein the second horizontally polarized dipole antenna is located in an area between the first horizontally polarized dipole antenna and the reflector.

9. The antenna element according to claim 5, wherein the first feeding structure comprises:

a first feeding point, wherein the first feeding point is electrically connected to the ground plate;

a first feeder, wherein the first antenna branch and the third antenna branch are electrically connected to the first feeding point by the first feeder;

a second feeding point, wherein the second feeding point is electrically connected to the ground plate; and a second feeder, wherein the second antenna branch and the fourth antenna branch are electrically connected to the second feeding point by the second feeder; and the second feeding structure comprises:

a third feeding point, wherein the third feeding point is electrically connected to the ground plate;

a third feeder, wherein the fifth antenna branch and the seventh antenna branch are electrically connected to the third feeding point by the third feeder;

a fourth feeding point, wherein the fourth feeding point is electrically connected to the ground plate; and a fourth feeder, wherein the sixth antenna branch and the eighth antenna branch are electrically connected to the fourth feeding point by the fourth feeder.

10. The antenna element according to claim 9, wherein the third feeder comprises a first feeder segment and a second feeder segment, the first feeder segment is connected to the fifth antenna branch and the seventh antenna branch, the second feeder segment is connected to the seventh antenna branch and the third feeding point, the fourth feeder comprises a third feeder segment and a fourth feeder segment, the third feeder segment is connected to the sixth antenna branch and the eighth antenna branch, the fourth feeder segment is connected to the eighth antenna branch and the fourth feeding point, a width of the first feeder segment is less than that of the second feeder segment, and a width of the third feeder segment is less than that of the fourth feeder segment; and/or the first feeder comprises a fifth feeder segment and a sixth feeder segment, the fifth feeder segment is connected to the first antenna branch and the third antenna branch, the sixth feeder segment is connected to the third antenna branch and the first feeding point, the second feeder comprises a seventh feeder segment and an eighth feeder segment, the seventh feeder segment is connected to the second antenna branch and the fourth antenna branch, the eighth feeder segment is connected to the fourth antenna branch and the second feeding point, a width of the fifth feeder segment is less than that of the sixth feeder segment, and a width of the seventh feeder segment is less than that of the eighth feeder segment.

11. The antenna element according to claim 9, wherein the third feeder comprises a first feeder segment and a second feeder segment, the first feeder segment is connected to the fifth antenna branch and the seventh antenna branch, the second feeder segment is connected to the seventh antenna branch and the third feeding point, the fourth feeder comprises a third feeder segment and a fourth feeder segment, the third feeder segment is connected to the sixth antenna branch and the eighth antenna branch, and the fourth feeder segment is connected to the eighth antenna branch and the fourth feeding point;

there is a gap between the first feeder segment and the second feeder segment; and there is a gap between the third feeder segment and the fourth feeder segment.

12. The antenna element according to claim 1, wherein the first feeding structure comprises:

a first feeding point, wherein the first feeding point is electrically connected to the ground plate;

a first feeder, wherein the first antenna branch and the third antenna branch are electrically connected to the first feeding point by the first feeder;

a second feeder, wherein the second feeder is connected to each of the second antenna branch and the fourth antenna branch, and is electrically connected to the ground plate by a trapezoidal balun structure, wherein the first feeder is coupled to the second feeder.

13. The antenna element according to claim 1, wherein a plane where the first antenna branch, the second antenna branch, the third antenna branch, and the fourth antenna branch are located penetrate the focus and the vertex of the parabola.

14. The antenna element according to claim 5, wherein at least one of the first vertically polarized dipole antenna, the second vertically polarized dipole antenna, the first horizontally polarized dipole antenna, or the second horizontally polarized dipole antenna is a millimeter-wave antenna.

15. An electronic device, comprising at least two antenna elements, wherein one of the at least two antenna elements comprises:

a substrate, wherein the substrate has a ground plate;

a first vertically polarized dipole antenna, wherein the first vertically polarized dipole antenna comprises a first antenna branch and a second antenna branch, and the first antenna branch and the second antenna branch are disposed in the substrate at an interval;

a second vertically polarized dipole antenna, wherein the second vertically polarized dipole antenna comprises a third antenna branch and a fourth antenna branch, and the third antenna branch and the fourth antenna branch are disposed in the substrate at an interval;

a reflector, wherein the reflector comprises several reflection pillars, and the several reflection pillars are arranged in the substrate at intervals along a parabola; and a first feeding structure, wherein the first feeding structure electrically connects each of the first antenna branch, the second antenna branch, the third antenna branch, and the fourth antenna branch to the ground plate, wherein the first antenna branch, the second antenna branch, the third antenna branch, and the fourth antenna branch are all located on a focus side of the parabola; and lengths of the first antenna branch and the second antenna branch are both less than lengths of the third antenna branch and the fourth antenna branch.

16. The electronic device according to claim 15, wherein the at least two antenna elements are sequentially connected to form an antenna array.

17. The electronic device according to claim 16, wherein an isolator is disposed between every two adjacent antenna elements.

18. The electronic device according to claim 17, wherein the isolator comprises several isolation pillars that are arranged at intervals, and the isolation pillars penetrate the substrate.

19. The electronic device according to claim 15, wherein the antenna element further comprises:

a first horizontally polarized dipole antenna, wherein the first horizontally polarized dipole antenna comprises a fifth antenna branch and a sixth antenna branch, and the fifth antenna branch and the sixth antenna branch are disposed in the substrate at an interval;

a second horizontally polarized dipole antenna, wherein the second horizontally polarized dipole antenna comprises a seventh antenna branch and an eighth antenna branch, and the seventh antenna branch and the eighth antenna branch are disposed in the substrate at an interval; and a second feeding structure, wherein the second feeding structure electrically connects each of the fifth antenna branch, the sixth antenna branch, the seventh antenna branch, and the eighth antenna branch to the ground plate, wherein the fifth antenna branch, the sixth antenna branch, the seventh antenna branch, and the eighth antenna branch are all located on the focus side of the parabola;

lengths of the fifth antenna branch and the sixth antenna branch are both less than lengths of the seventh antenna branch and the eighth antenna branch;

the first antenna branch and the second antenna branch are respectively located on two sides of a first plane where the fifth antenna branch, the sixth antenna branch, the seventh antenna branch, and the eighth antenna branch are located;

the third antenna branch and the fourth antenna branch are respectively located on two sides of the first plane where the fifth antenna branch, the sixth antenna branch, the seventh antenna branch, and the eighth antenna branch are located;

the fifth antenna branch and the sixth antenna branch are respectively located on two sides of a second plane where the first antenna branch, the second antenna branch, the third antenna branch, and the fourth antenna branch are located; and the seventh antenna branch and the eighth antenna branch are respectively located on two sides of the second plane where the first antenna branch, the second antenna branch, the third antenna branch, and the fourth antenna branch are located.

20. The electronic device according to claim 15, wherein the first feeding structure comprises:

a first feeding point, wherein the first feeding point is electrically connected to the ground plate;

a first feeder, wherein the first antenna branch and the third antenna branch are electrically connected to the first feeding point by the first feeder;

a second feeder, wherein the second feeder is connected to each of the second antenna branch and the fourth antenna branch, and is electrically connected to the ground plate by a trapezoidal balun structure, wherein the first feeder is coupled to the second feeder.

* * * * *